US006085944A

United States Patent [19]

Lang et al.

[11] Patent Number: 6,085,944

[45] **Date of Patent: *Jul. 11, 2000**

[54] SYRINGE METERING UNIT FOR BOTTLE TOP DISPENSER

[75] Inventors: Andreas Lang, Marktheidenfeld; Hubert Kunze, Kreuzwertheim, both of Germany

[73] Assignee: Brand GmbH & Co., Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/010,658

[22] Filed: Jan. 22, 1998

[30] Foreign Application Priority Data

Jan. 27, 1997 [DE] Germany ..... 197 02 778

[51] Int. Cl.[7] ..... B67D 5/42

[52] U.S. Cl. ..... 222/386; 422/100; 604/110

[58] Field of Search ..... 222/386; 422/100; 604/110

[56] References Cited

U.S. PATENT DOCUMENTS

| | | | |
|---|---|---|---|
| 4,117,728 | 10/1978 | Johnson . | |
| 4,750,373 | 6/1988 | Shapiro . | |
| 5,207,646 | 5/1993 | Brunnel | 604/110 |

FOREIGN PATENT DOCUMENTS

| | | |
|---|---|---|
| 98 10 0972 | 4/1998 | European Pat. Off. . |
| 682722 | 11/1993 | Switzerland . |
| PCT/CA94/00271 | 5/1994 | WIPO . |

*Primary Examiner*—Kevin Shaver
*Assistant Examiner*—David Deal
*Attorney, Agent, or Firm*—Galgano & Burke

[57] ABSTRACT

A syringe made of plastic serves as a metering part for a bottle-top dispenser. It includes a piston-cylinder unit, which has a cylinder sleeve with an installation opening for the piston, and a retainer ring for the piston which lies in front of the installation opening and which is clipped onto the cylinder sleeve in such a way that the piston cannot be pulled out of the cylinder.

8 Claims, 2 Drawing Sheets

SYRINGE METERING UNIT FOR BOTTLE TOP DISPENSER

BACKGROUND OF THE INVENTION

The invention relates to a syringe made of plastic, with a piston-cylinder unit, for a pipetting device.

Such syringes are usually made from plastic, by means of injection molding. It is known in this connection to form a circumferential bead into the wall of the cylinder liner, against which the piston comes to rest in its maximum extension position. When the syringe is assembled, the piston is pressed over the bead from the outside. If sufficient force is applied, it is therefore also possible to pull the piston out of the cylinder over the bead, which can result in undesired splashing of liquid out of the syringe.

In case of such incorrect operation, the syringe is broken, for now, but the user can repair it by pressing the piston back into the cylinder over the bead.

SUMMARY OF THE INVENTION

It is the object of the invention to create a syringe of the type stated initially, with which incorrect operation is prevented and operational reliability is improved.

This object is accomplished by such a syringe in that the piston cannot be pulled out of the cylinder of the piston-cylinder unit.

An attempt to pull the piston out of the cylinder of a syringe according to the invention should fail in that the syringe breaks at another, less critical point, preferably in such a way that it becomes irreparably non-functional, but does not leak.

In a preferred embodiment, a retainer ring for the piston is countersunk in the cylinder of the piston-cylinder unit. The retainer ring prevents the piston from being pulled completely out of the cylinder. Before the user is able to get the piston out of the cylinder over the retainer ring, the piston-cylinder unit preferably breaks at another, less critical point.

The retainer ring can be switched between an active and inactive position. In the inactive state, it is supposed to permit installation of the piston in the cylinder and removal of the piston from the cylinder.

In a preferred embodiment, the piston has a piston head and a piston rod. The cylinder has a bottom with an intake and ejection opening, and a cylinder liner into which the piston head fits, forming a seal. The cylinder liner is open at its end facing away from the cylinder bottom, so that the piston can be installed in it. The retainer ring for the piston lies in front of the installation opening, and it is sized in such a way that the piston head does not fit through the retainer ring, but the piston rod does.

Preferably, the piston rod is guided in the retainer ring. This guidance counteracts tilting of the piston when filling and emptying the syringe.

The syringe is preferably sized in such a way that it is more likely that the piston rod will break or come off the piston head or that a connector piece of the syringe will tear out of its counterpart than that the piston head will overcome the retainer ring.

In a preferred embodiment, the retainer ring is circlipped onto the cylinder liner or circlipped into the cylinder liner. Also, the retainer ring can be glued or welded onto the cylinder liner, or formed from the cylinder liner by subsequent deformation.

The syringe according to the invention has a preferred use as a piston-cylinder metering unit for a bottle top dispenser.

BRIEF DESCRIPTION OF THE DRAWINGS

The invention will be explained in greater detail below, on the basis of an exemplary embodiment shown in the drawing.

FIG. 1 shows the piston in the entirely compressed position, FIG. 2 shows the piston in the entirely extended position, corresponding to the full metering stroke and FIG. 3 shows the piston in the securing contact position;

DETAILED DESCRIPTION OF THE PREFERRED AND ILLUSTRATED EMBODIMENT

Figure 1:
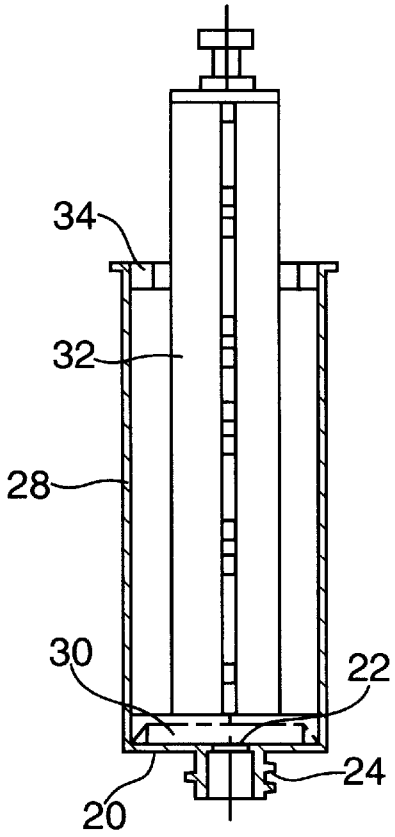
FIGS. 1–3 show side views of a syringe with a piston-cylinder unit, for a pipetting device, where

The syringe is an interchangeable part, made of plastic, with a piston-cylinder unit, for a pipetting device, particularly a bottle top dispenser.

The syringe has a cylinder bottom 20 with a central intake and ejection opening 22, which is surrounded by a cylindrical connector piece 24 which projects axially downward. The connector piece 24 forms a sealing Luer lock connection with the valve housing of a pipetting device.

The syringe has a circular cylindrical liner 28 for a piston, which consists of a piston head 30 and a piston rod 32. The piston head 30 is seated in the cylinder liner 28 so as to move axially, forming a seal. The piston rod 32 is attached to the piston head 30 centrally and axially, and projects out of the cylinder liner 28 at the top.

Instead of as just described, the cylinder bottom 20 can also be conical, and the piston head 30 can be correspondingly conical.

The end of the cylinder liner 28 which faces away from the cylinder bottom 20 is open for installation of the piston. After installation has taken place, a retainer ring 34 for the piston is inserted into the installation opening of the cylinder liner 28, and permanently connected with the latter. The retainer ring 34 is sized in such a way that the piston rod 32 fits through it.

Figure 4:
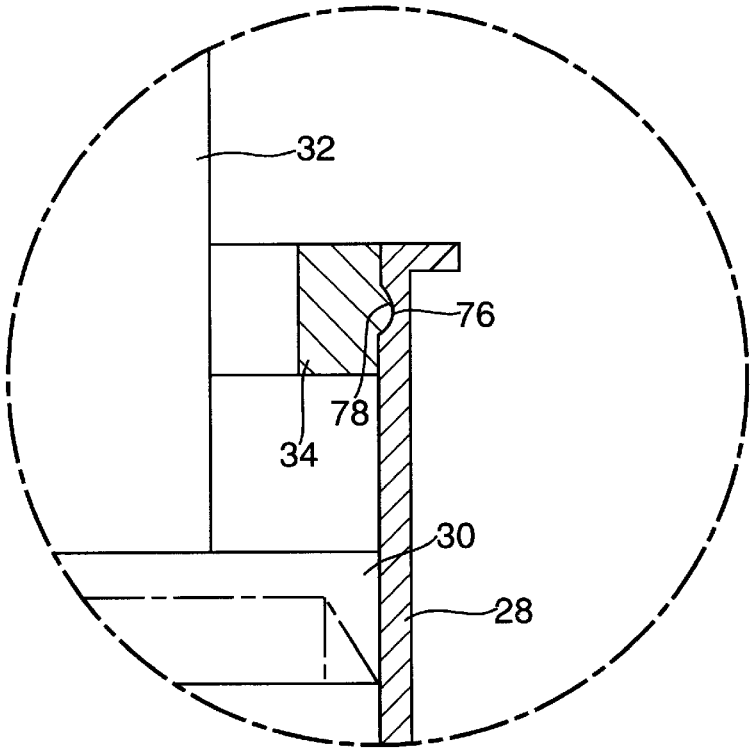
FIG. 4 shows a retainer ring circlipped into the cylinder of the piston-cylinder unit, as an enlarged detail of FIG. 2.

In accordance with FIG. 4, the retainer ring 34 is circlipped into the cylinder liner 28 of the piston-cylinder unit. The cylinder liner 28 has a circumferential annular groove 76 on its inside mantle, and the retainer ring 34 has a circumferential annular bead 78 on its outside mantle, which bead fits into the annular groove 76 with a positive lock. The annular groove 76 has an arc-shaped profile and the annular bead 78 has a corresponding crowned spherical curvature.

Figure 5:
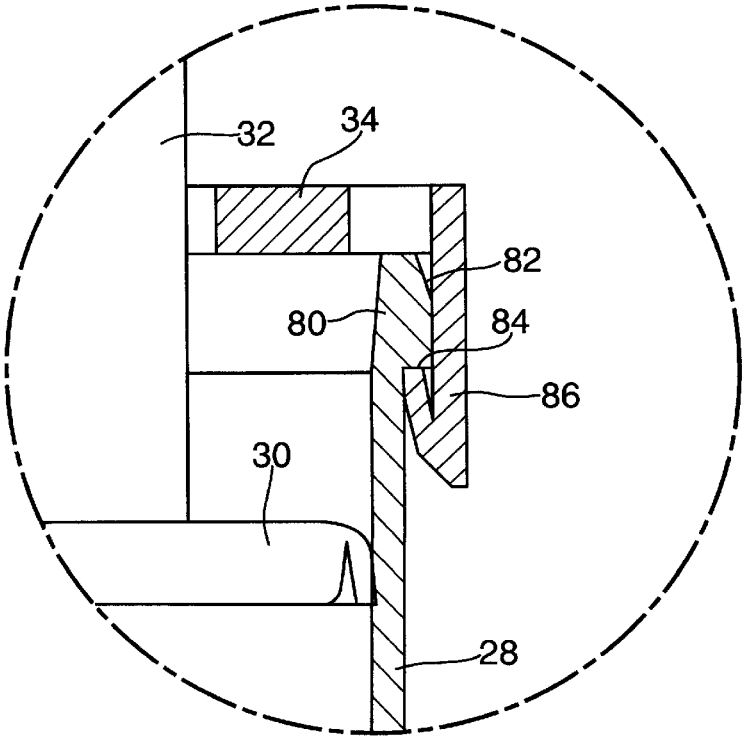
FIG. 5 shows a retainer ring, circlipped onto the cylinder, in the same manner.

In accordance with FIG. 5, the retainer ring 34 is circlipped onto the cylinder liner 28 of the piston-cylinder unit. A hook 80 which is radially circumferential and projects outward axially and radially is formed onto the cylinder liner 28; it has a ramp 82 and an undercut 84 behind it on its end, on the outside. The retainer ring 34 has counterhooks 86 uniformly distributed over its circumference, at the edge, which can be pressed over the ramp 82 of the hook 80, spreading elastically, and fall into the undercut 84.

Figure 2:
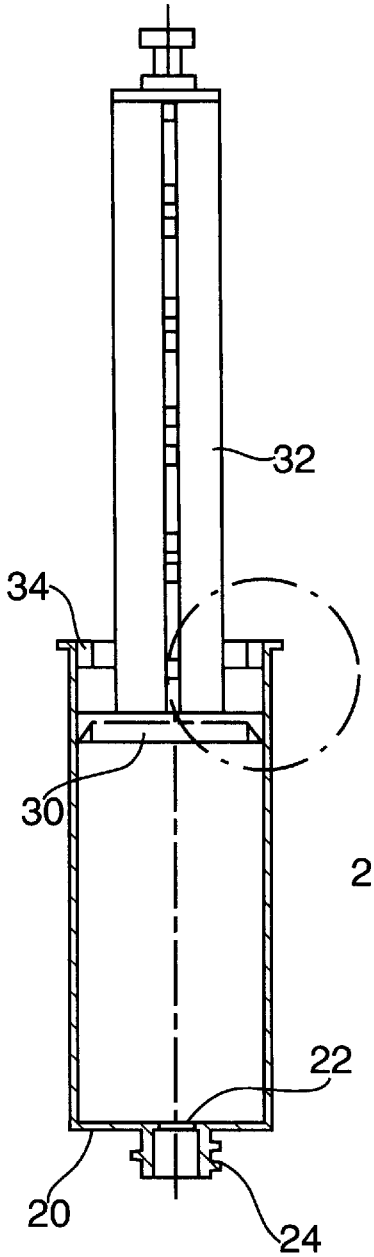
Figure 3:
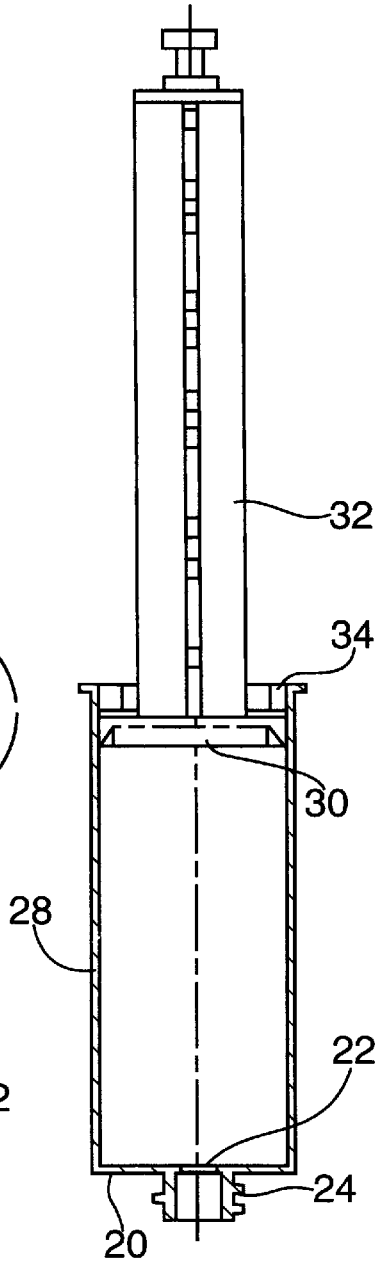

As shown in FIG. 2, the piston has a stroke reserve in the cylinder, beyond its full metering stroke, in case of incorrect operation. The piston head 30 assumes a securing contact position on the retainer ring 34 beyond the full metering stroke.

What is claimed is:

1. A syringe made of plastic which serves as a metering part for a bottle-top dispenser comprising:

a piston-cylinder unit, which incudes a cylinder sleeve with an installation opening for the piston;

a retainer ring for the piston which lies in front of the installation opening, said retainer ring being clipped onto said cylinder sleeve in such a way that the piston cannot be pulled out of the cylinder;

a circumferentially-extending hook disposed on said cylinder sleeve which projects radially outwardly from said sleeve; and at least one counter hook disposed on said retainer ring which is configured and dimensioned to resiliently engage said hook so that said retainer ring is affixed to said sleeve.

2. The syringe according to claim 1, wherein a retainer ring for the piston is countersunk in said cylinder.

3. The syringe according to claim 1, wherein said piston has a piston head and a piston rod, wherein said cylinder has a bottom with an intake and ejection opening and a cylinder liner into which the piston head fits, forming a seal, said cylinder liner having an installation opening for the piston at its end facing away from the cylinder bottom, and wherein said retainer ring lies in front of the installation opening, and that the piston rod fits through said retainer ring and is guided in it.

4. The syringe according to claim 3, wherein said syringe is dimensioned and configured such that said piston rod will break or come off the piston head or that a connector piece of the syringe will tear out of its counterpart before said piston head will pass by and be freed from said retainer ring.

5. The syringe according to claim 1, wherein said retainer ring is releasably clipped to said cylinder liner.

6. The syringe according to claim 1, wherein said retainer ring is glued or welded onto said cylinder liner.

7. The syringe according to claim 1, wherein a plurality of said counter hooks are circumferentially and uniformly distributed on said retainer ring.

8. The syringe according to claim 7, wherein said hook has a ramp-like outer portion and an undercut portion and wherein said counter hooks are dimensioned and configured to press over said ramp-like outer portion and fall into said undercut portion.

* * * * *